US009945650B2

(12) United States Patent
Rubin

(10) Patent No.: US 9,945,650 B2
(45) Date of Patent: Apr. 17, 2018

(54) BIOLOGICAL ACTIVE BULLETS, SYSTEMS, AND METHODS

(71) Applicant: Darren Rubin, Largo, FL (US)

(72) Inventor: Darren Rubin, Largo, FL (US)

( * ) Notice: Subject to any disclaimer, the term of this patent is extended or adjusted under 35 U.S.C. 154(b) by 0 days.

(21) Appl. No.: 15/193,801

(22) Filed: Jun. 27, 2016

(65) Prior Publication Data

US 2016/0298947 A1 Oct. 13, 2016

Related U.S. Application Data

(63) Continuation-in-part of application No. 14/615,671, filed on Feb. 6, 2015, now Pat. No. 9,377,278, which is a continuation-in-part of application No. 13/461,863, filed on May 2, 2012, now Pat. No. 9,200,877.

(51) Int. Cl.
*F42B 12/54* (2006.01)
*F42B 12/72* (2006.01)

(52) U.S. Cl.
CPC ..... *F42B 12/54* (2013.01); *F42B 12/72* (2013.01)

(58) Field of Classification Search
CPC ..... F42B 12/36; F42B 12/38; F42B 12/40; F42B 12/44; F42B 12/46; F42B 12/54; F42B 12/72
USPC ..... 102/511, 512, 513, 458, 364, 365
See application file for complete search history.

(56) References Cited

U.S. PATENT DOCUMENTS

| | | | | |
|---|---|---|---|---|
| 3,938,517 | A * | 2/1976 | Anderson | A61K 9/0041 119/14.19 |
| 4,598,096 | A * | 7/1986 | Grant | C06D 3/00 102/512 |
| 4,854,238 | A * | 8/1989 | Vaice | F41B 11/57 102/371 |
| 8,997,653 | B1 * | 4/2015 | Calvert | F42B 5/02 102/439 |
| 9,377,278 | B2 * | 6/2016 | Rubin | F42B 12/54 |
| 2007/0009694 | A1 * | 1/2007 | Monk | B60K 15/03177 428/35.7 |
| 2009/0042946 | A1 * | 2/2009 | Moore, II | A61K 31/165 514/338 |
| 2012/0070470 | A1 * | 3/2012 | Pahari | A61F 13/00034 424/400 |

* cited by examiner

*Primary Examiner* — Bret Hayes

(57) ABSTRACT

A hemostatic bullet projectile is for discharge from a firearm and for use as a weapon. The ammunition is a bullet in a cartridge. The bullet projectile includes, and is distinguished by, the use of at least one potentially biological active substance delivered to a bullet wound of a target and serving as a hemostatic agent to promote blood clotting and/or control hemorrhage in the bullet would to stabilize the target until surgery can be performed. Methods are included to promote blood clotting and/or control hemorrhage in at least one bullet wound by delivery of a hemostatic agent by the bullet projectile causing the wound as well as minimizing the risk of embolism from the hemostatic bullet projectile.

1 Claim, 3 Drawing Sheets

Fig. 3A
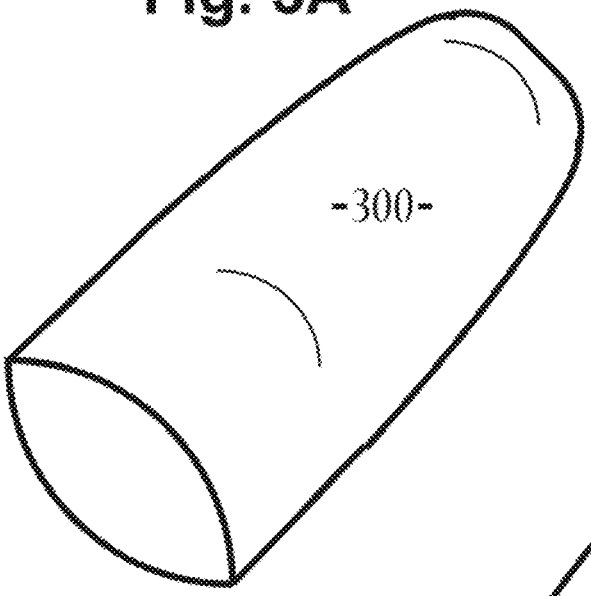
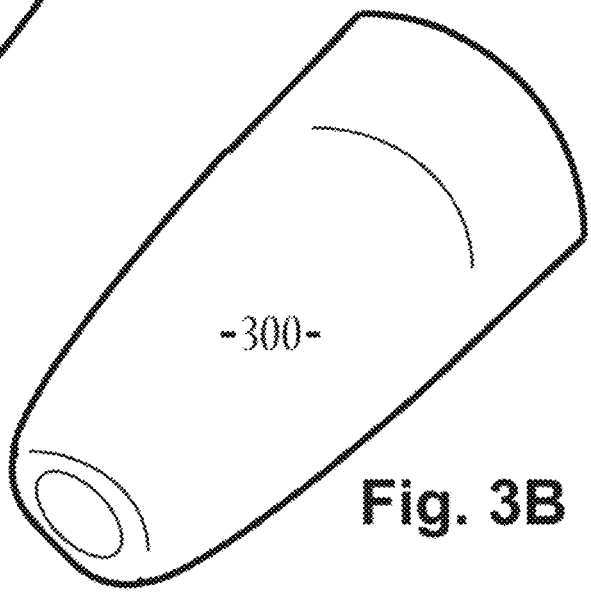
Fig. 3B
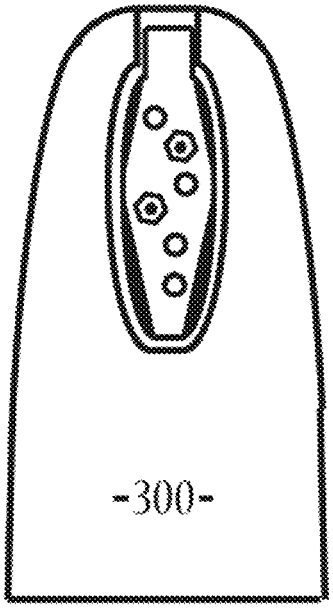
Fig. 3C

BIOLOGICAL ACTIVE BULLETS, SYSTEMS, AND METHODS

RELATED APPLICATION

The present application is a continuation-in-part of pending U.S. patent application Ser. No. 14/615,671 filed Feb. 6, 2015, which is a continuation-in-part of U.S. patent application Ser. No. 13/461,863 filed May 2, 2012, now U.S. Pat. No. 9,200,877, the subject matter of which is incorporated herein by reference.

BACKGROUND OF THE INVENTION

Field of the Invention

The present invention relates to a novel biological active bullet and more particularly pertains to a method for delivering at least one biological active substance to the body of a target upon bullet impact and penetration. The term "biological active substance" refers to any material that is biological, pharmaceutical, chemical, or radioactive that has at least some biological effect on or within the body of a target. This biological effect may include, but is not limited to, the interaction of this active substance with at least one of: organ systems, tissues, bodily fluids, cells, intracellular structures, and biochemicals. For instance, the desired biological effect of this biological bullet may include convulsions and disorientation that incapacitates a dangerous target. Or, the active substance delivered by this bullet may include stopping the heart or respiration of the target from an otherwise, non-fatal bullet wound. Biological active bullets can have the potential to make every shot fatal, and thus, have the ability to conserve ammunition. The result of biological effects serve additional functions not seen in other bullets, and therefore, the present invention also includes numerous other uses and improvements, with the ability to enhance modern warfare. Furthermore, the present invention allows the delivery of biological active substances to a target from a safe distance. This may prove useful in treating or neutralizing a disoriented or rabid individual carrying an infectious agent with epidemic potential. The present invention also affords the ability to deliver a wide range of active substances and combinations of active substances, and the ability to activate a substance upon impact and penetration.

Biological active bullets also have the ability to reduce or prevent lethality of a bullet wound, such as by preventing excessive bleeding and severe hypovolemic shock, and even exsanguination before critical care is available in a hospital setting. Biological active bullets that reduce or prevent lethality of a bullet wound have applications in police work and civilian use when stopping a target in self-defense is necessary, but the killing of the target is to be avoided, if possible. Biological active bullets that reduce or prevent lethality of a bullet wound also have applications for special forces missions or central intelligence when a target holds important information that is to be extracted, which would otherwise be lost should the target die from a fatal bullet wound.

BACKGROUND

Bullets are projectiles discharged and propelled from a firearm, such as a hand gun or rifle. Bullets have the primary function of piercing a living target, such as a human enemy, such as for military combat or self-defense.

Bullets have evolved many times over several centuries, resulting in many improvements, such as modern-day, metal jacketed bullet cartridges, invented by Swiss Major Eduard Rubin in the late 1800s, as described in U.S. Pat. No. 468,580.

The firing of a bullet at a target causes ballistic trauma, otherwise known as a gunshot wound or bullet wound. A penetrating bullet causes a disruption in tissue and a cavitation in the body, which is associated with severe bleeding or hemorrhage. Significant loss of blood often causes hypovolemic shock marked by diminished blood pressure, decreased organ perfusion and inadequate delivery of oxygen. If bleeding cannot be stopped, bleeding to death or bleeding out, otherwise known as exsanguination, can occur with the loss of even half the body's blood volume.

The immediate, default method of treating a bullet wound until help can arrive is to cover the wound opening with a cloth and apply pressure to the wound to help stop the bleeding and form a clot. Yet, this may not be effective. With a bullet wound, it is very possible for a target to bleed out before emergency care can arrive and transfuse blood products and surgically repair the wound; even if emergency care can arrive or have access to the patient in a timely manner, which is not always the case. While applying external compression with bandages to a projectile wound has been used for many centuries, the modern era has seen the elucidation of the blood coagulation or clotting cascade and the discovery of hemostatic agents; agents that control and arrest bleeding to achieve hemostasis, such as by promoting the formation of blood clots. A substance that is hemostatic serves to reduce or stop bleeding.

A number of hemostatic agents exist, including: natural and synthetic clay and silicate materials such as zeolite, kaolinite, and diatomaceous earth; glass and glass-ceramics; polymeric polysaccharides such as algae and shellfish derived chitin, chitosan, and alginate; polymeric proteins; other polymers, such as polyacrylates; glass powders, beads or fibers, such as surface reactive glass-ceramics; and plasma-derived or recombinant clotting factors, such as thrombin, fibrinogen and fibrin; even synthetic nanoparticles and nanofibers. These hemostatic agents may be in the form of powders, gels, or impregnated into gauze bandages and other dressings.

Out in the field, if even carried by police or first responders, these hemostatic agents may be applied topically to the entry site of a penetrating wound, or added to bandages, when applying pressure to the wound with the hope of clot formation. What makes a bullet wound difficult to treat is that it often has a narrow point of entry and a long tubular track associated with deeper, intracavitary bleeding. With considerable blood flowing out of the entry site, most attempts of applying a hemostatic agent near the entry site of a wound will fail to stop bleeding deep within the patient, and the hemostatic agent may even dilute or wash away. When intracavitary bleeding is located below or proximal a large bone, such as the pelvis, shoulder, or thorax, the bone can block the ability of the first responder to apply compression to the wound. In a hospital or operating room setting, a hemostatic agent may be applied deep inside a wound if a patient has been opened under surgery or if the hospital has some sort of long catheter device that may deliver a hemostatic agent. But out in the field, there is no way practical way to get a hemostatic agent deep inside the bullet track to stop intracavitary bleeding. Therefore, any attempt of applying a hemostatic agent near the entry site of a bullet wound may be no more effective than applying pressure to the wound without a hemostatic agent present.

Therefore, it can be appreciated that there exists a need for a placing a hemostatic agent deep inside a bullet wound, and as quickly as possible, while out in the field, to promote clot formation and control intracavitary bleeding so the target can live long enough to receive proper medical attention.

In the media, there have been public protests following incidents of police fatally shooting a suspect or person of interest. In some instances, police have been suspended or even sentenced for such killing. While weapons such as tasers are generally non-lethal, tasers cannot take the place of guns carried by police. When a police officer or civilian is in imminent danger from a suspect, only a loaded gun can provide multiple rounds of maximum stopping power. However, once the suspect has been stopped and the police officer or civilian are no longer in danger, there need not be a reason for the suspect to die on the scene from bleeding out after being shot. Therefore, it can also be appreciated that there exists a need for an effective, yet less lethal bullet that can prevent bleeding out.

The current invention fulfills these needs by providing methods of hemostatic agent delivery with a bullet; along with bullet projectiles containing hemostatic agents and capable of promoting clot formation. The hemostatic action of these bullet projectiles and methods are immediate and can reduce or prevent bullet wound lethality. The current invention provides for a new ammunition for police and civilian use.

SUMMARY OF THE INVENTION

In view of the foregoing disadvantages inherent in the known types of bullet cartridges and projectiles of known designs and configurations now present in the prior art, the present invention provides an improved bullet projectile; a bullet projectile that becomes biologically active to promote clot formation and reduce lethality of its bullet wound; as well as methods for delivering a hemostatic agent via a bullet projectile to immediately promote clot formation deep inside a bullet wound to control bleeding in order to keep a target alive until the target can receive emergency medical care or surgery. As such, the general purpose of the present invention, which will be described subsequently in greater detail, is to provide a new and improved bullet projectile that is effective at stopping a target, but also promotes blood coagulation to reduce lethality by preventing severe hypovolemic shock and exsanguination. This biological active bullet system and method has all the advantages of prior art bullet projectiles and none of the disadvantages.

To attain this, the present invention essentially comprises a bullet in a cartridge. As with most cartridges, the cartridge of the present invention generally includes a bullet, a case/shell, a propellant, such as gunpowder or cordite, a primer which ignites the propellant once the firearm is triggered, along with an annular groove and flange of the casing, at the back-end of the bullet, that aids in loading the cartridge. The bullet optionally includes a jacket. Importantly, the bullet includes at least one potentially biological active substance not involved in the propelling of the bullet, the bullet capable of being fired as a projectile from a firearm, and delivering the at least one potentially biological active substance in the target upon impact and penetration. The at least one potentially biological active substance reacting with a bodily fluid from the target to become biologically active and to promote blood coagulation and or reduce or arrest hemorrhage, and thus, this bullet projectile having additional functions and applications than prior art bullets.

The present invention also includes methods of associating the at least one potentially biological active substance to the bullet projectile, such as during manufacture, or out in the field. The present invention also includes methods of using the biological active bullet cartridge, including loading and discharging the cartridge to affect the target with the unique features of this novel invention to reduce the lethality of the bullet projectile.

In this respect, before explaining at least one embodiment of the invention in detail, it is to be understood that the invention is not limited in its application to the details of construction and to the arrangements of the components set forth in the following description. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hemostatic bullet projectile which has all of the advantages of prior art bullets of known designs and configurations and none of the disadvantages.

It is another object of the present invention to provide a new and improved hemostatic bullet projectile and cartridge which may be easily and efficiently manufactured and marketed.

It is a further object of the present invention to provide a new and improved biological active bullet system which is of durable and reliable constructions.

An even further object of the present invention is to provide a new and improved biological active bullet system which is susceptible of a low cost of manufacture with regard to both materials and labor, and which accordingly is then susceptible of low prices of sale, thereby making such biological active bullet system economical. Because the hemostatic bullet projectile has the ability to rapidly cause blood coagulation, this invention also has potential to keep a target alive long enough to extract vital information.

Even still another object of the present invention is to provide a hemostatic bullet projectile for delivering at least one biological active substance to the body of a target upon bullet impact and penetration.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying descriptive matter of preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3A shows a bottom-up side view of the primary embodiment biological active bullet after leaving its cartridge.

FIG. 3B likewise shows this biological active bullet from a top-down side perspective.

FIG. 3C shows the longitudinal cross-section of this biological active bullet separate from its cartridge.

DETAILED DESCRIPTION OF THE INVENTION

Figure 1:
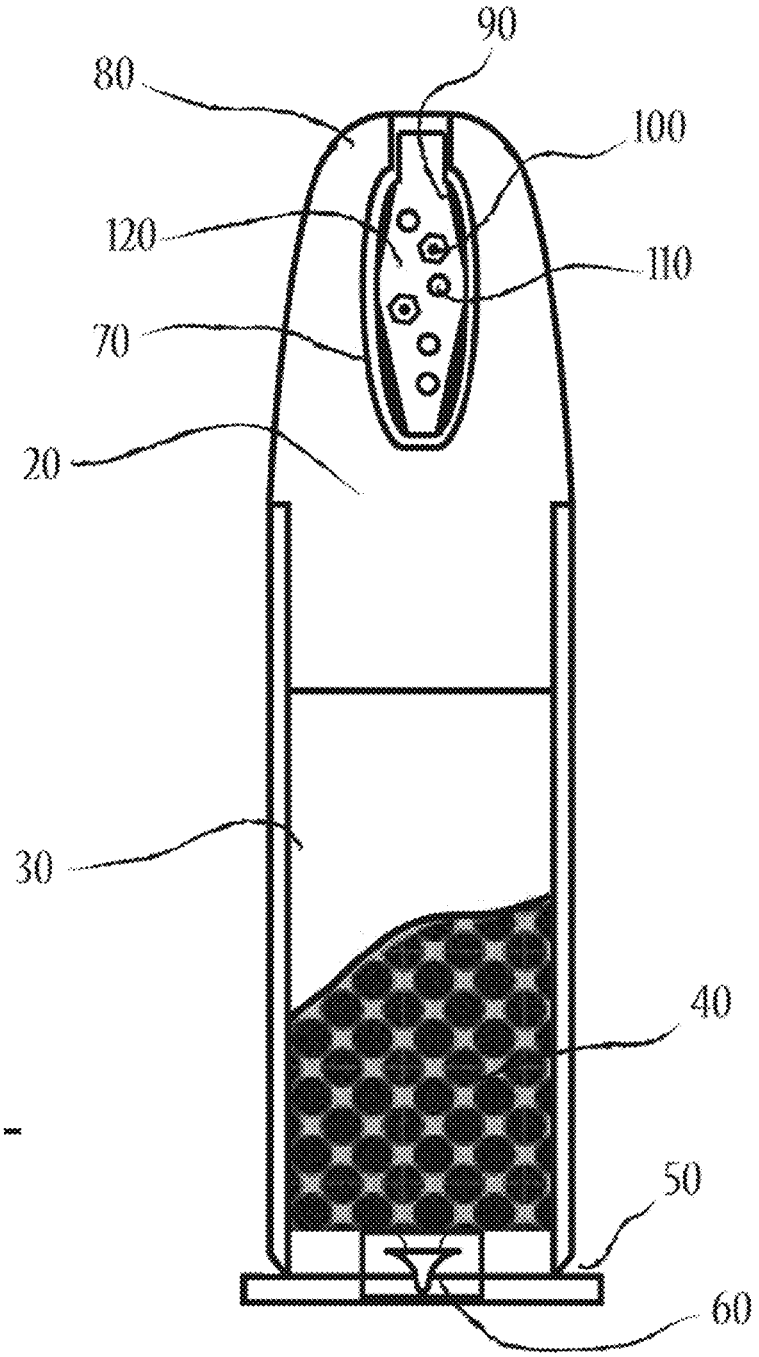
FIG. 1 is a primary embodiment of a new and improved biological active bullet cartridge, shown as a longitudinal cross-section, and revealing main components. There is a cavity near the tip of the bullet that is filled with a cap/plug that is associated with two different potentially biological active substances.

The preferred embodiment(s) of a new and improved hemostatic bullet projectile, a biological active bullet system and method embodying the principles and concepts of the present invention, will be described.

The present invention is a less lethal, hemostatic bullet projectile structured to be packaged in a cartridge/shell and structured to be discharged from a firearm and used as a weapon. Ammunitions of the present invention are preferably structured to be used with existing handguns and rifles, such as those currently used by police and the military. Accordingly, biological active projectile bullet cartridges of the present invention, in their broadest context, include a bullet, which serves as the projectile; the case/shell, which holds the cartridge components; the propellant, which may preferably be gunpowder or cordite; the primer, which ignites the propellant once the firearm is triggered; along with an annular groove and flange of the casing, at the back-end of the bullet, that aids in loading the cartridge or extracting the empty cartridge (i.e., an extractor groove). The bullet optionally includes a jacket. The bullet optionally includes a surface that interacts with the rifling of the firearm barrel by having grooves and or by being deformed by the riffling of the firearm barrel during discharge. Such components generally comprise a modern bullet cartridge and are not meant to be limiting. The structure of the bullet projectile, and its jacket, preferably and in most embodiments, includes solid metal and preferably has a similar look, feel, weight, and ballistics as standard police ammunition.

Importantly, the less lethal, hemostatic bullet projectile of the biological active projectile bullet cartridges of the present invention includes, and is distinguished by the use of, at least one potentially biological active substance not involved in the propelling of the bullet projectile to a target. The at least one potentially biological substance undergoes at least one physical and or chemical change when the at least one potentially biological active substance comes in contact with and is triggered by and interacts directly with a bodily fluid of the target, such as a non-heated bodily fluid of bodily temperature of the target, following impact and penetration of the bullet projectile with the target. The at least one physical and or chemical change produces at least one result in at least one bullet wound that reduces or arrests hemorrhage to reduce or prevent lethality of the bullet projectile. The at least one result in at least one bullet wound that the at least one physical and or chemical change produces is chosen from the group consisting of cauterization, promoting (stimulating, initiating, and or accelerating) blood coagulation, absorbing fluid, expansive filling and obstructing within, and applying intracavitary pressure against, the at least one bullet wound. In some embodiments, bacteriocidation is a secondary result of the at least one physical and or chemical change that occurs when at least one potentially biological active substance comes in contact with and is triggered by and interacts with a bodily fluid, which can prevent severe or fatal sepsis. The target is preferably a human target, such as a human combatant, although this weapon could also be used on an animal, such as an exotic zoo or safari animal when a human life is in danger and a tranquilizer dart will not be sufficient to stop the animal quickly enough, yet the life of the exotic animal is worth saving.

In some embodiments, the bullet projectile includes an at least one potentially biological active substance not involved in the propelling of the bullet projectile to a target that undergoes at least one exothermic chemical reaction when the at least one potentially biological active substance comes in contact with and is triggered by and interacts directly with a non-heated bodily fluid of bodily temperature of the target, following impact and penetration of the bullet projectile with the target.

Cauterization of at least some portion of the bullet wound is the result of heat produced in at least one exothermic chemical reaction that occurs when the at least one potentially biological active substance comes in contact with and reacts with a bodily fluid. The high heat produced melts flesh and burns tissue, such as blood vessels, to help seal the wound or hemorrhaging vessel. The heat produced from this at least one exothermic chemical reaction also rapidly heats blood in its vicinity, causing the lysis or exploding of blood platelets, so that these platelets release their contents of clotting factors and platelet-activating mediators to promote a clotting cascade with intact blood platelets. This clotting, deep inside the bullet wound can stop hemorrhaging vessels from bleeding, especially when clotting spreads along or throughout the bullet track. The cauterization of tissue and vessels, along with clotting formation, produces a synergistic effect to control bleeding from the wound. Cauterization may also seal off the wound from additional exposure to bacteria to prevent sepsis.

The bullet projectile itself may be contaminated with bacteria, or may bring contaminated clothing or skin inside the wound with it. The high heat from the at least one exothermic chemical reaction that occurs when the at least one potentially biological active substance comes in contact with and reacts with a bodily fluid, such as blood, is also great enough to lyse or explode bacterial cells in its vicinity. This property of bacteriocidation can prevent severe or fatal sepsis, should the bacteria otherwise grow and spread within the bullet wound and enter other portions of the circulatory system.

The quantity of this at least one potentially biological active substance can be chosen based on the amount of heat energy given off in the at least one exothermic chemical reaction. For example, Group I and Group II elements, including elemental lithium, elemental sodium, elemental potassium, elemental rubidium, elemental cesium, elemental calcium, elemental strontium, elemental barium, and elemental radium, along with their alloys, were found to produce violent exothermic heat when coming in contact with aqueous bodily fluid, such as blood. For this reason, only small or trace amounts of these substances may be needed for cauterization, otherwise greater damage and fatality can result. There are a host of other substances that can react with aqueous bodily fluid to produce a significant exothermic chemical reaction; carbides and hydrides, such as calcium carbide and calcium hydride, acetic anhydride, phosphorus pentoxide, sodium amide, sodium hydrosulfite, sodium peroxide, to name a few. These examples are not meant to be limiting, and other substances that undergo a significant exothermic reaction with aqueous bodily fluid may be used for this purpose. Some of these substances produce hydroxides and gases that may further react with other substances associated with the bullet projectile or other substances in the blood.

When one or more gases are produced faster than they can escape, these gases can apply intracavitary pressure within and against the bullet wound, and thus provide compression to the walls of the bullet wound, to aid in stopping the bleeding.

Bacteriocidation may also be the result of destructive oxidation of bacterial cells from oxidative substances released or produced when the at least one potentially biological active substance comes in contact with and reacts with bodily fluid. For example, if an at least one potentially biological active substance not involved in the propelling of the bullet projectile to a target is sodium peroxide powder, it will react with water to release hydrogen peroxide, which can decontaminate bacteria introduced by the bullet projectile. Hydrogen peroxide also reacts with the enzyme catalase in the blood to produce water and copious amounts of foaming oxygen gas bubbles that can also raise intracavitary pressure within and against the bullet wound. The foaming action may reduce the risk gas embolism.

In other embodiments, the promoting of blood coagulation is the result of the at least one potentially biological active substance absorbing and or adsorbing aqueous fluid of the blood plasma and locally hemo-concentrating blood platelets, clotting factors, and or platelet-activating mediators to initiate clotting. For instance, substances with a hygroscopic property, including natural and synthetic clay and silicate materials, and some forms of diatomaceous earth can comprise at least one potentially biological active substance of the bullet projectile. Clay minerals are hydrous aluminum phyllosilicates which form flat hexagonal sheets or plates, and include the kaolin group with minerals such as kaolinite, the smectite group with minerals such as saponite and montmorillonite, of which bentonite consists mostly of montmorillonite, the illite group, the chlorite group, and other clay minerals such as attapulgite and sepiolite. Other silicates include zeolites, which are somewhat similar to clay minerals, but instead of being plate-shaped, they form a three-dimensional crystal structure or framework characterized by numerous internal and external pores.

Zeolites are microporous aluminosilicate minerals that occur naturally in volcanic formations. As aluminosilicates, zeolites consist of silicon, aluminum and oxygen atoms. The silicon ions are neutral in the three-dimensional crystal structure, while the aluminum ion has a negative charge, which holds cations such as sodium, potassium, calcium or magnesium, or protons in the cage-like pores as counter-ions. The cations are not strongly bound to the zeolite molecule so they can be easily replaced or exchanged with other cations. The porosity and electrostatic nature of zeolites allow them to capture and hold (absorb and adsorb) vast amounts of water. Permutites are artificial aluminosilicates that resemble the zeolites. There are about 50 naturally occurring zeolites, such as natrolite, analcime, chabazite, heulandite, phillipsite, and stilbite, along with approximately 150 synthetic zeolites. When zeolites come in contact with water, a chemical reaction adsorbs the water and releases heat. In some instances, this heat may contribute to bullet wound cauterization and blood clotting when the zeolite or permutite, such as a calcium-exchanged zeolite or permutite, is released from the bullet projectile and interacts with aqueous fluid in the blood.

Some clays are known as expansive clays which experience a large volume change; they swell after absorbing water. Clay minerals especially of the smectite group, for example sodium activated bentonites, have the most dramatic swell capacity and good gelling properties. When associated and delivered by the bullet projectile, clay minerals have the potential to provide some expansive filling and or obstructing of the bullet wound after interacting with and absorbing aqueous bodily fluid, such as blood plasma or lymph, which may help reduce bleeding and provide a porous matrix and contact surface for clotting to take place. For instance, blood factor XII may be activated by exposure to this contact surface. Additionally, blood flowing over sharp sections of the clay may introduce mechanical shear which may activate blood factor VIII. In this way, the clotting cascade can be promoted. The one or more clay minerals associated with the bullet projectile can be in the form of powder, granules, beads, paste, gel, or electrospun with polymers.

In some embodiments, porous glass beads or glass-ceramics with a reactive surface can also provide a good surface for blood clotting to be initiated.

Expansive filling and or obstructing of the bullet wound is also achieved by other swelling agents and superabsorbent polymers. Swelling with an aqueous fluid can be a physical change. Swelling agents are generally hydrophilic polymer chains that may be chemically or physically cross-linked into a three-dimensional network and able to swell up to one thousand times their own weight when placed in an aqueous environment, such as in blood plasma or lymph. The cross-linking prevents infinite dissolution. Chemical hydrogels are a class of swelling agent where all polymer chains have covalent bond cross-linking. Physical hydrogels often react with ions or other functional groups. Some swelling agents may also absorb organic materials. Some examples of swelling agents include polyvinyl alcohol polymers and polyvinylic foams, cross-linked vinyl pyrrolidone polymers, along with algae and shellfish derived chitin, chitosan, and alginate hydrocolloids. Chitin is a long polymer chain of N-acetylglucosamine, while chitosan is a long polymer of glucosamine and N-acetylglucosamine. Chitin and chitosan, and derivatives of them, perhaps because of their positive charge, have the ability to attract plasma proteins and the cell membranes of blood cells and platelets, leading to platelet activation and thrombus formation; other properties may lead to vasoconstriction. Cross-linked polyacrylic acid, such as sodium polyacrylate, is another superabsorbant polymer able to absorb up to 300 times its mass in water. After being released and or exposed to bodily fluid in the bullet wound after impact and penetration of the bullet projectile, the superabsorbant polymer is able to interact with the fluid and expand, fill, and at least partially obstruct blood flowing from inside the bullet wound to slow this blood flow, accumulate or concentrate platelets and clotting factors, and promote clotting. The expansion may also help separate or release a cap/plug or other hemostatic agents from the bullet projectile.

Other embodiments contain two or more substances that react together after impact and penetration of the bullet projectile. For example, the hemostatic agent can be a solidifying foam that expands inside the bullet wound to obstruct bleeding. An example of a solidifying foam is one made of polyurethane, created by the mixing of polyol and isocyanates. Other embodiments include monomer and polymers that cross-link upon mixing together inside the bullet wound. An example of this are cyanoacrylates, which have adhesive like properties. Mucoadhesive properties can also help clot formation and help stop hemorrhaging. When blood platelets are entrapped in a pore or matrix, they will begin to clot. New generation of hemostatic agents include peptides that self assemble into a nanofiber scaffold inside the blood, and may be delivered by the bullet projectile of this invention.

Preferred embodiments of the invention include a bullet projectile containing or associated with plasma-derived or recombinant clotting factors, such as thrombin, fibrinogen and or fibrin; which delivers and releases these clotting factors inside the bullet wound to promote clotting with the target's own blood platelets. Other clotting factors such as factor VIII and factor IX, can also be included, especially for targets with hemophilia. Clotting factors are typically inactive enzyme precursors (zymogens) of serine proteases that become active along the clotting cascade to result in the polymerization of fibrin protein which forms the clot. Natural and synthetic zymogens, enzymes, co-factors, signaling molecules and lipids, liposomes, even liposomal vesicles that can affect intracellular clotting signaling, may be included with this bullet projectile. For example, thromboxane is a vasoconstrictor lipid that helps promote platelet aggregation. Platelet surface receptor fragments, such as coupled to serum albumin, may also be included in some embodiments. A host of other synthetic and derivative factors may become available for use with this invention. These examples are not meant to be limiting. If these clotting factors or clotting mediators are lyophilized, they will become active upon interaction with aqueous blood plasma. Going into solution or suspension is often a physical change.

The blood clotting cascade consists of one or more of the following clotting factors and or platelet-activating mediators, including factors:

I Fibrinogen;
II Prothrombin;
III Tissue factor or thromboplastin;
IV Calcium ions;
V Proaccelerin (Labile factor);
VII Proconvertin (Stable factor);
VIII Antihaemophilic factor A, Antihaemophilic globulin;
IX Antihaemophilic factor B, Plasma thromboplastin component, Christmas factor;
X Stuart-Prower factor;
XI Plasma thromboplastin antecedent, Haemophilia C,
XII Hageman factor;
XIII Fibrin stabilizing factor, Laki-Lorand factor;
along with platelet membrane phospholipids and tissue factors; as well as Vitamin K.

In some embodiments, clotting factors or signaling molecules may be cross-linked or covalently bound to a swelling agent or glass bead to create hybrid hemostatic agents.

In some embodiments, the at least one potentially biological active substance at least locally increases the viscosity of the surrounding blood fluid to reduce blood flow.

In some embodiments, an antibiotic substance can be included along with hemostatic agents in the bullet projectile.

In still further embodiments, at least two potentially biologically active substances have a synergistic effect on promoting blood clotting and or controlling bleeding or hemorrhage.

The technological difficulty of this invention is that small hemostatic particles, such as powders and small granules can pose a risk in entering blood vessels and causing a clot in the circulatory system which can travel elsewhere and could lead to arterial, venous, or pulmonary embolism, thus leading to a serious blockage, stroke or cardiac infarction. Gas producing chemical reactions of hemostatic agents can also lead to gas embolism. The challenge was in creating a bullet projectile that reduces lethality by promoting blood clotting and stopping hemorrhage, while minimizing the inherent risk of embolism. Choice of potentially biological active substance and its sizing is just one factor. Self-adherent properties and structural integrity can be another factor. Additional substances and or protective mechanisms can be used to further minimize this risk or prevent embolism. For example, the at least one biologically active substance can be cross-linked to larger substances or protected in liposomal structures.

Other essential features of the biological active bullet system include the association of the new and improved bullet projectile with the at least one potentially biological active substance; along with preventing the at least one potentially biological active substance from undergoing at least one physical and or chemical change before the impact and penetration of the bullet projectile with the target. This can include preventing the at least one potentially biological active substance from reacting during projectile manufacturing and projectile firing from a firearm.

The association of the bullet projectile with the at least one potentially biological active substance, not involved in the propelling of the bullet projectile to a target, can be achieved by various means. The prevention of the at least one potentially biological active substance from undergoing at least one physical and or chemical change before reaching the intended target can also be achieved by various means. The following embodiment examples provided herein are not meant to be limiting.

With reference now to the drawings, and in particular to FIG. 1 thereof, the preferred embodiment of the new and improved biologically active projectile bullet embodying the principles and concepts of the present invention and generally designated by the reference numeral 10 will be described.

The present invention, the biological active projectile bullet cartridge 10 is comprised of a plurality of components. Such components in their broadest context include a bullet 20, which serves as the projectile; the case 30, which holds the cartridge components; the propellant 40, which may be gunpowder or cordite; part of the casing used for loading 50; and the primer 60, which ignites the propellant. Such components generally comprise a modern bullet. Further included is a cavity or hollow point region 70 near the tip 80 of the bullet. This cavity or hollow point 70 is filled at least partially by a cap/plug 90. The cap/plug is associated with at least one potentially biological active substance that is delivered to a mammalian target, such as a human. The at least one potentially biological active substance is or becomes a hemostatic agent when interacting with the target's blood inside the bullet wound. The at least one potentially biological active substance produces at least one result in the at least one bullet wound chosen from the group consisting of cauterization, promoting of blood coagulation, absorbing fluid, expansive filling and obstructing within, and applying intracavitary pressure against the at least one bullet wound; at least one result to reduce or arrest hemorrhage and to reduce or prevent lethality of the bullet projectile. Bacteriocidation may also be a result. In most embodiments, the at least one potentially biological active substance undergoes at least one physical and or chemical change when the at least one potentially biological active substance comes in contact with a bodily fluid of the target, including blood, following impact and penetration of the bullet projectile with the target.

FIG. 1 is shown with two groups of potentially biological active substances, group A particles 100 and group B particles 110, although any number or combination of different potentially biological active substances may be present. In one example, group A and group B particles consist of lyophilized, recombinant thrombin and fibrinogen, respectively. Upon impact and penetration of the bullet projectile, group A and group B particles are exposed to aqueous blood plasma and become activated. The thrombin cleaves the fibrinogen into fibrin, and clotting is rapidly initiated. Clotting continues with the target's own clotting factors and platelets. Alternatively, group A particles can consist of an already cross-linked fibrin scaffold to capture blood platelets, while group B particles can be something other than a clotting factor. For example, group B particles can be a porous clay or silicate material, such as a zeolite, or a porous glass bead that hemo-concentrates platelets and clotting factors. The zeolite can heat its surrounding vicinity when absorbing aqueous fluid. Group B particles may produce an even stronger exothermic reaction with blood plasma if it consists of elemental sodium, elemental calcium, or elemental potassium, and should be used in much smaller amounts. The heat released is able to release clotting factors from nearby platelets and cauterize the bullet wound. Group B particles can also be a swelling agent, such as chitin or chitosan. Cap/plug 90 may also contain or be combined with sodium polyacrylate or another polymeric foam. Cap/plug 90 may also contain or be combined with electrospun materials. In other embodiments, group A particles and group B particles can be monomers and or polymers that cross-link to form a matrix surface for clotting to take place, and or to produce a solidifying foam that will cause expansive filling and obstructing inside the bullet wound, and put intracavitary pressure against the tissue of the bullet wound, to stop hemorrhaging. If group A particles are a substance that produces gas, such as sodium peroxide particles, that gas can also exert intracavitary pressure in conjunction with a group B swelling agent or polymer that becomes a solid foam, thereby enhancing compression on the wound. These examples are neither exhaustive nor limiting.

Cap/plug 90 may be non-hollow, or may, itself, contain at least one hollow cavity 120 as shown in FIG. 1 that contains the at least one potentially biological active substance. This cap/plug may be comprised of material that is rigid, semi-rigid, non-rigid, resilient, frangible, or non-frangible. This cap/plug may stay intact upon impact or may fragment. This cap/plug may be porous and have active substances embedded in it, or may dissolve when in contact with bodily fluids, thereby releasing hemostatic agents. In alternative embodiments, this cap/plug may consist of the active substance itself or as a mixture of the active substance with other excipients. In other words, this cap/plug may serve as a vial containing active substances, or serve as a scaffold for holding and delivering active substances, or function like a tablet. In some embodiments, cap/plug 90 consists of a fibrous or electrospun material, that may be gauze-like or fabric-like, and itself be a hemostatic agent, and or have other hemostatic agents associated or embedded in it. Cap/plug 90 may be first compressed before assembling into the bullet projectile so that it uncompresses and expands or exposes its surface area in the bullet wound environment.

Figure 2:
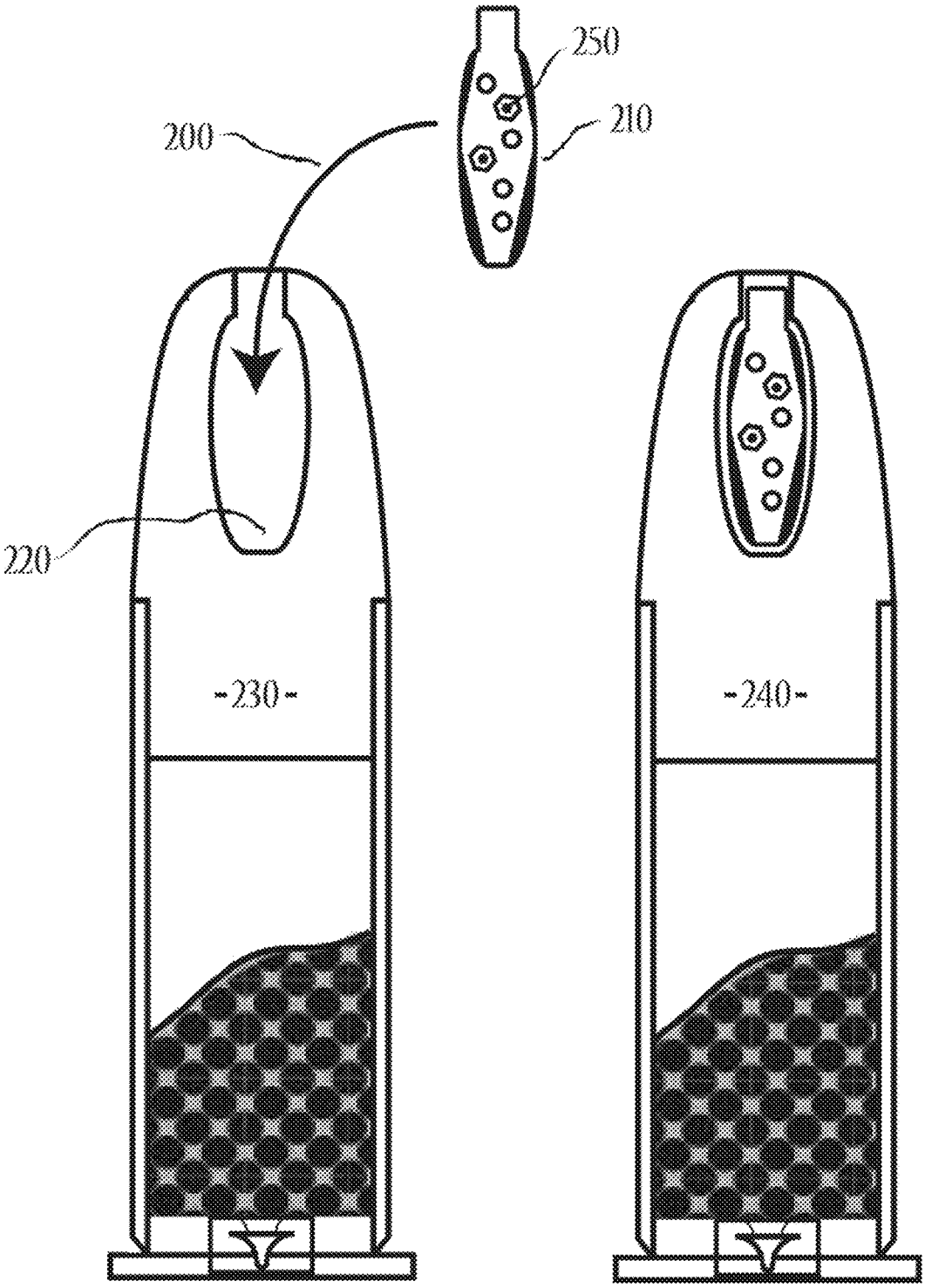
FIG. 2 describes the method of assembling this cap/plug of the primary embodiment into the empty hollow cavity of the bullet. Longitudinal cross-sections are shown.

FIG. 2 describes the method of assembly, as shown by directional arrow 200, of inserting the cap/plug 210 into hollow bullet cavity 220 of bullet 230, prior to loading the assembled cartridge 240 into a firearm and discharging the biological active projectile bullet. Cap/plug 210 is associated with at least one potentially biological active substance and or hemostatic substance 250. Cross-sections are shown.

FIG. 3A shows a bottom-up side view of the biological active projectile bullet 300 that has been discharged from the assembled cartridge 240 of FIG. 2, while FIG. 3B shows a top-down side view of this bullet. FIG. 3C shows the cross-section of this biological active bullet.

In most if not all of the embodiment examples, it is essential that the at least one potentially biologically active substance is protected from reacting with an environment external to the bullet projectile before the impact and penetration of the bullet projectile with the target. Otherwise, the at least one potentially biological active substance would almost certainly undergo physical or chemical reaction with oxygen and moisture from atmosphere and or the combustible gases from the bullet's discharge; which would likely degrade the substance, cause it to prematurely swell, and or inactivate the substance before entering the bullet wound; and may even cause harm to the shooter, other cartridges, and or the firearm itself. As ammunition can get wet from rain or being submerged, an important feature of the invention is for the bullet projectile to be weatherproof/waterproof to protect the at least one potentially biological active substance, such as before the projectile reaches its target. Water repellent materials, coatings, and even laser etched surfaces and patterns can protect the bullet projectile from moisture and liquids before reaching the target.

Therefore, the bullet projectile can further include at least one inert, excipient substance that protects the at least one potentially biological active substance from undergoing a physical or chemical change before the impact and penetration of the bullet projectile with the target. As such, the bullet projectile can further include at least one protective substance chosen from the group consisting of mineral oil, petroleum jelly, wax, and polymer that protects the at least one potentially biological active substance from undergoing a physical or chemical change before the impact and penetration of the bullet projectile. Excipients may also help insulate the at least one potentially biological active substance from the heat of firing the projectile.

Yet, excipients can also play an important role in associating the bullet projectile with the at least one potentially biological active substance. Therefore, the bullet projectile can further include at least one excipient substance that at least partially associates the at least one potentially biological active substance with the bullet projectile at least before the impact and penetration of the bullet projectile with the target. Such excipients may also aid in associating other active substances and or other excipients. Excipients may adhere the at least one potentially biological active substance to a inner surface of the bullet jacket, or a surface, channel, pore, or cavitation of the bullet projectile; either directly, or indirectly via other excipients or structural materials. If the adherent excipient will touch the at least one potentially biological active substance directly, then the adherent excipient, such as a natural or synthetic resin, is selected to be unreactive with the at least one potentially biological active substance. In this case, tiny holes/pores are made in the at least one potentially biological active substance and possibly the bullet projectile body surface as well. Then, mechanical bonds can form as the adhesive excipient seeps into these tiny holes/pores and solidifies while the adhesive excipient's cohesive forces maintain integrity. Alternatively, the adherent excipient may not touch the at least one potentially biological active substance directly. Instead, the at least one potentially reactive biological active may be encapsulated by a protective coating, which itself may be an excipient or structural material. Then, the adhesive excipient may form chemical bonds (e.g., absorption or chemisorption) with the protective encapsulation without risk of reacting with the at least one potentially biological active substance before reaching a target.

Other embodiments of the bullet projectile exist which differ from the Figures shown. For example, at least one potentially biologically active substance may line a cavity of the projectile, and may be protected by other coating excipients or structures or projectile structural components. The cap/plug may not be utilized in some embodiments. In other embodiments of the invention, a cap/plug optionally helps seal a channel, pore, or cavitation of the bullet projectile containing the at least one potentially biological active substance. Alternatively, such a cap/plug can seal a channel, pore, or cavitation of the bullet projectile containing a vial, such as, but not limited to a glass or plastic vial, which contains the at least one potentially biological active substance. Again, adhesives can also be employed in these embodiments. Alternatively still, the cap/plug can be comprised of material that is rigid, semi-rigid, non-rigid, resilient, frangible, or nonfrangible. This cap/plug may stay intact upon impact or may fragment. This cap/plug may be porous and have the at least one potentially biological active substance embedded in it, or may dissolve when in contact with bodily fluids. In some embodiments, this cap/plug may be comprised of the at least one potentially biological active substance itself or as a mixture, composition, or formulation of the at least one potentially biological active substance and other excipients. In other words, this cap/plug may serve as a vial containing potentially biological active substances, or serve as a scaffold for holding and delivering potentially biological active substances, or function like a tablet.

For example, the potentially biological active substance may help form a solid of a desired shape that is adapted to fit the shape of the cavity as a cap/plug, to help retain the substance in a fixed position, so as to help prevent interference with the bullet's trajectory. In other examples, the cap/plug can be secured by the jacket of the bullet, or the cap/plug may have securing means, such as threads designed adapted to fit complementary securing means, such as threads, in the bullet cavity.

These embodiment examples are not meant to be limiting. Other structural and functional relationships of the bullet projectile and the at least one potentially biological active substance can exist. The invention is a projectile structured to be discharged from a firearm, chosen from the class of projectiles, including, but not limited to, bullets, and further selected from the class of bullets, including, but not limited to, non-frangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets; and further associated with at least one potentially biological active substance to promote hemostasis of the bullet wound that the bullet projectile causes.

If the at least one potentially biological active substance is a swelling agent or a substance that undergoes a bubbling reaction with aqueous fluid in the blood, the substance upon getting wet in bodily fluid may aid in the release and or dissociation of it and other hemostatic agents associated with the bullet projectile. Additionally, the at least one biologically active substance can be made to be released along the bullet track, even before the bullet comes to rest or even if the bullet projectile were to exit through the target. Importantly, the bullet projectile of the biological active bullet system according to the invention has unexpected properties that existing bullet projectiles do not have. Therefore, the bullet projectile according to the invention represents a major advancement in bullet ammunitions technology, especially for police and civilian use. These unexpected results further reduce the lethality of the bullet projectile and represent a vast improvement over existing prior art bullets.

The bullet projectile of the present invention is capable of delivering a wide range of quantity of at least one potentially biological active substance, such as less than, up to, and over, one gram, along with different volumes and densities of these substances.

The bullet projectile of the invention is preferably structured to be discharged from a firearm; although in some alternative embodiments; the bullet projectile of the invention may be structured to be propelled by air guns or rail guns.

In preferred embodiments, the bullet projectile of the invention is structured to be propelled from a bullet propelling device, including, but not limited to, hand guns, revolvers, semi-automatic weapons, automatic weapons, rifles, and sniper rifles; although in some alternative embodiments, the bullet projectile of the invention may be structured to be propelled from shotguns.

The bullet projectile of the invention is preferably chosen from the class of bullets, including, but not limited to, nonfrangible bullets, frangible bullets, hollow point bullets, hollow point bullets with a cap/plug contained in at least some of the hollow point, bullets with at least one pit/cavity, bullets with at least one at least partially filled pit/cavity, bullets with at least one interior chamber, soft-point bullets, boat-tailed bullets, round nose bullets, plated bullets, non-jacketed bullets, and jacketed bullets. In some embodiments, the bullet projectile comprises no more than one or two bullet body portions; while in alternative embodiments, the bullet projectile comprises more than two bullet body portions or a plurality of subprojectiles.

The biological active bullet ammunition system preferably includes a cartridge containing a bullet projectile of the invention, and preferably includes a cartridge containing at least a propellant and a bullet projectile of the invention, and still more preferably, includes a cartridge containing at least a propellant, a primer, a case/shell, and a bullet projectile of the invention. The invention may also be a magazine containing at least one cartridge containing a bullet projectile according to the invention. The invention may also be a firearm, such as but not limited to a gun, containing at least one cartridge of bullet projectile according to the invention. Although less preferable, in other embodiments the firearm may also be unique in that it can be further specifically adapted to load and discharge at least one specifically adapted bullet projectile according to the invention.

Importantly, the bullet projectile is capable of making a normally non-fatal gunshot wound less fatal by controlling bleeding. The bullet projectile is also capable of maintaining adequate ballistics, such as, but not limited to, aerodynamic efficiency, synchronized spin, trajectory, and range.

The body of the bullet projectile can be comprised of at least one material chosen from the group of hard materials, including, but not limited to, aluminum, antimony, beryllium, bismuth, boron carbide, brass, bronze, chromium, cobalt, copper, gold, iridium, iron, lead, mercury, molybdenum, nickel, palladium, platinum, rhodium, silicon carbide, silver, steel, hardened steel, tantalum, tellurium, tin, titanium, tungsten, tungsten carbide, carbon fiber, depleted uranium, zinc, zirconium, metalloids, alloys, and any combinations thereof. However, in some alternative embodiments, polymers and carbon-based-materials may be used. These examples are not meant to be limiting. The polymers and other substances used in this invention do not function as binders to hold metal powders together as structural bullet body sections of the projectile.

The bullet projectile may further include at least one radiopaque marker, or the at least one potentially biological active substance may be radiopaque, so that the bullet projectile components and hemostatic materials can be removed from the target during operation by being detected in medical imaging, such as X-ray. Alternatively, the bullet projectile may further include at least one substance that responds to radio-frequency detection.

The bullet projectile is capable of including potentially biological active substances in a variety of formats, such as solids, liquids, gels, pastes, films, fast-dissolving formats, slow-release formats, along with a variety of excipients that may aid the delivery of the substance(s).

The invention may also be a biological active bullet ammunition system that is able to deliver at least one substance of a wide range of different biologically active substances to a target to cause a biological effect.

The invention may also be a biological active bullet ammunition system that is able to deliver a combination of different biologically active substances to a target to cause a combination of biological effects.

The at least one biological active substance may exist in an active state or a potentially active state. Substances that exist in a potentially active state require activation. Activation may be achieved by various ways, such as from interaction with the target itself, including bodily tissues and fluids, bodily enzymes, and extracellular, cellular, or mitochondrial proteins and cofactors; and or the conditions therein, such as the temperature and pH found in the body. For example, the potentially active substance may require processing by bodily protease enzymes for activation, or require mineral cofactors found in the target's blood. In other examples, activation may take place from the interaction of the substance with an excipient, other active, or other substance, also associated with the bullet. For instance, the potentially active substance may be a catalyst requiring a cofactor for significant activation. This cofactor may also be associated with the bullet, but unable to interact with the catalyst until the two substances are mixed together during impact and penetration of the bullet.

The invention may also be an interchangeable cap/plug and biologic active bullet system, so that a cap/plug associated with at least one potentially biologic active substance can be interchanged with a cap/plug associated with a different potentially biologic active substance, so as to vary/customize the desired biologic effects using the same cartridge platform.

The invention may also be a non-interchangeable cap/plug and biologic active bullet system, so that a cap/plug associated with at least one potentially biologic active substance cannot be interchanged with a cap/plug associated with a different potentially biologic active substance, the bullet and bullet cavity are adapted to fit only a specific cap/plug associated with a certain biologic active substance, so as to prevent confusion and tampering of the bullet system.

The invention also includes methods of constructing and manufacturing the bullet projectile with the at least one potentially biological active substance, along with methods of use of the bullet projectile, including, but not limited to, methods of loading and firing the bullet projectile, methods of delivering with this bullet at least one potentially biological active substance to a target, along with methods of use of ensuring enhanced hemostatic properties and reduced lethality, along with methods of minimizing risk of embolism.

The invention may also be a method of applying a potentially biological active substance within a cavity of a bullet, chosen from bullet cavities, such as, but not limited to, a hollow point cavity. The invention may also be a hollow point bullet projectile with at least one potentially biological active substance occupying at least some portion of the hollow point cavity. The invention may also be a method of applying an at least one potentially biological active substance to deep within a cavity of a bullet, chosen from bullet cavities, such as, but not limited to, a hollow point cavity, such as to ensure that the at least one potentially biological active substance cannot be touched by the firearm user, such as by not coming into contact with the with hands or fingers, when handling the bullet cartridge.

The invention includes a bullet projectile structured to be packaged in a cartridge/shell and structured to be discharged from a firearm and used as a weapon to produce at least one bullet wound in a target. The bullet projectile includes, and is distinguished by the use of, at least one potentially biological active substance not involved in the propelling of the bullet projectile to the target. The at least one potentially biological active substance undergoes at least one physical and or chemical change when the at least one potentially biological active substance comes in contact with and is triggered by and interacts with a bodily fluid of the target, such as blood, following impact and penetration of the bullet projectile with the target. The at least one physical and or chemical change produces at least one result in the at least one bullet wound chosen from the group consisting of cauterization, promoting of blood coagulation, absorbing fluid, expansive filling and obstructing within, and applying intracavitary pressure against, the at least one bullet wound to reduce or arrest hemorrhage and to reduce or prevent lethality of the bullet projectile.

The cauterization can be the result of heat produced in at least one exothermic chemical reaction that occurs when the at least one potentially biological active substance comes in contact with and reacts with the bodily fluid in the at least one bullet wound.

The bacteriocidation can be the result of heat produced in at least one exothermic chemical reaction that occurs when the at least one potentially biological active substance comes in contact with and reacts with the bodily fluid in the at least one bullet wound; the heat lyses or explodes bacterial cells associated with the bullet projectile and or bacterial cells associated with the target's skin or clothing brought inside the bullet wound of the target by the bullet projectile.

The bacteriocidation can also be the result of destructive oxidation of bacterial cells associated with the bullet projectile and or bacterial cells associated with the target's skin or clothing brought inside the bullet wound of the target by the bullet projectile; the destructive oxidation caused by oxidizing agents released and or produced when the at least one potentially biological active substance comes in contact with and reacts with the bodily fluid in the at least one bullet wound.

The promoting blood coagulation can be the result of the release of clotting factors and platelet-activating mediators from the lysis or exploding of blood platelets from heat produced in at least one exothermic chemical reaction that occurs when the at least one potentially biological active substance comes in contact with and reacts with the bodily fluid, primarily blood, in the at least one bullet wound; the release of clotting factors and platelet-activating mediators promote a clotting cascade with intact blood platelets.

The promoting blood coagulation can also be the result of the release of plasma-derived, recombinant, or synthetic clotting factors, platelet-activating mediators, other organic or inorganic clotting inducers, enzymes, zymogens, enzyme cofactors, signaling molecules, and or surface receptor fragments associated with the bullet projectile to promote a clotting cascade with intact blood platelets.

The promoting blood coagulation can also be the result of the at least one potentially biological active substance absorbing aqueous fluid in the blood and hemo-concentrating blood platelets, clotting factors, and or platelet-activating mediators.

The promoting blood coagulation can also be the result of the at least one potentially biological active substance providing a reactive surface that serves as a clotting substrate.

The promoting blood coagulation can also be the result of the at least one potentially biological active substance providing a porous surface or matrix to accumulate blood platelets, clotting factors, and or platelet-activating mediators for initiation of clotting to place on.

The promoting blood coagulation can also be the result of the at least one potentially biological active substance attracting blood platelets with an electrostatic charge for the blood platelets to accumulate and activate a clotting cascade.

The promoting blood coagulation can also be the result of the at least one potentially biological active substance having a mucoadhesive property of attaching to tissues and or blood platelets for the blood platelets to accumulate and activate a clotting cascade.

The promoting blood coagulation within the bullet wound can also be the result of at least one potentially biological active substance swelling many times its initial volume within the bullet wound.

The expansive filling and obstructing within the bullet wound can be the result of at least one potentially biological active substance swelling many times its initial volume within the bullet wound.

The promoting blood coagulation within the bullet wound can also be the result of at least one potentially biological active substance forming a solidifying foam with the bullet wound.

The expansive filling and obstructing within the bullet wound can also be the result of at least one potentially biological active substance forming a solidifying foam with the bullet wound.

The promoting blood coagulation within the bullet wound can also be the result of at least one potentially biological active substance polymerizing within the bullet wound.

The expansive filling and obstructing within the bullet wound can also be the result of at least one potentially biological active substance polymerizing within the bullet wound.

The promoting blood coagulation within the bullet wound can also be the result of at least one potentially biological active substance self-assembling into a matrix or scaffold for blood clotting to take place on.

The bullet projectile can further be associated with a radiopaque marker or substance that responds to radio-frequency detection so the at least one biological active substance or resulting blood clot can be later located with medical imaging and or instruments and surgically removed.

The at least one potentially biological active substance is chosen and or sized to minimize the risk of causing an embolism, and or protected from causing an embolism.

The invention includes a bullet projectile structured to be packaged in a cartridge/shell and structured to be discharged from a firearm and used as a weapon to produce at least one bullet wound in a human target. The bullet projectile is associated with at least one hemostatic agent that is delivered to the at least one bullet wound in a human target upon impact and penetration of the bullet projectile with the human target; the bullet projectile with hemostatic agent promoting blood clotting and or controlling hemorrhage in the at least one bullet wound more rapidly and or more effectively than standard issue ammunition.

The invention also includes a method of promoting blood clotting and or controlling hemorrhage in at least one bullet wound. The method includes the steps of aiming a firearm at a human target and discharging from the firearm a bullet projectile associated with at least one hemostatic agent, and making the at least one hemostatic agent immediately available to interact with blood in the at least one bullet wound of the human target, while minimizing the risk of causing an embolism.

The invention may also be a method of manufacturing at least one bullet projectile according to the invention.

The invention may also be a method of adding at least one potentially biological active substance to at least one bullet projectile according to the invention.

The invention may also be a method of adding at least one potentially biological active substance to at least one bullet projectile according to the invention.

The invention may also be a method of adding at least one inactive substance to at least one bullet projectile according to the invention.

The invention may also be a method of adding at least one excipient to at least one bullet projectile according to the invention.

The invention may also be a method of adding at least one potentially biological active substance to at least one bullet projectile according to the invention using at least one excipient.

The invention may also be a method of switching potentially biologically active substances in at least one bullet projectile according to the invention The method may also include the adding or switching of potentially biological active substances and or other active substances out in the field.

The invention may also be a method of stabilizing over time a bullet projectile according to the invention and or at least one of its potentially biological active substance.

The invention may also be a method of storing a bullet projectile according to the invention.

The invention may also be a method of labeling and identifying a bullet projectile according to the invention.

The invention may also be a method of loading into a firearm, such as but not limited to a gun, at least one magazine or projectile cartridge of bullet projectile according to the invention.

The invention may also be a method of discharging/firing from a firearm, such as but not limited to a gun, at least one bullet projectile according to the invention.

The invention may also be a method of tracking a bullet projectile according to the invention after it has been discharged.

The invention may also be a method of activating an at least one potentially biologic active substance of a bullet projectile according to the invention after it has been discharged and or penetrated a target.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those described in the specification are intended to be encompassed by the present invention.

Therefore, the foregoing is considered as descriptive only of the principles of the invention. Further, since numerous modifications and changes will readily occur to those skilled in the art, it is not desired to limit the invention to the exact construction and operation described, and accordingly, all suitable modifications and equivalents may be resorted to, falling within the scope of the invention.

What is claimed as being new and desired to be protected by Letters Patent of the United States is as follows:

1. A method of promoting blood clotting and or controlling hemorrhage in at least one bullet wound;

said method including the steps of aiming a firearm at a human target and discharging from said firearm a bullet projectile associated with at least one hemostatic agent, and making said at least one hemostatic agent immediately available to interact with blood in said at least one bullet wound of said human target, while minimizing the risk of causing an embolism in said target.

* * * * *